US011486392B2

(12) United States Patent
Richter et al.

(10) Patent No.: US 11,486,392 B2
(45) Date of Patent: Nov. 1, 2022

(54) SCREW SPINDLE PUMP HAVING A STOP SURFACE AXIALLY ADJACENT TO AN END SURFACE OF A RUNNING SPINDLE

(71) Applicant: LEISTRITZ PUMPEN GMBH, Nuremberg (DE)

(72) Inventors: Ralf Richter, Fürth (DE); Oliver Trossmann, Oberasbach (DE)

(73) Assignee: LEISTRITZ PUMPEN GMBH, Nuremberg (DE)

( * ) Notice: Subject to any disclaimer, the term of this patent is extended or adjusted under 35 U.S.C. 154(b) by 0 days.

(21) Appl. No.: 17/398,250

(22) Filed: Aug. 10, 2021

(65) Prior Publication Data

US 2022/0186726 A1 Jun. 16, 2022

(30) Foreign Application Priority Data

Dec. 15, 2020 (DE) ..... 10 2020 133 555.5

(51) Int. Cl.
*F04C 2/16* (2006.01)
*F04C 15/00* (2006.01)

(52) U.S. Cl.
CPC ..... *F04C 2/16* (2013.01); *F04C 2/165* (2013.01); *F04C 15/0023* (2013.01); *F04C 2240/50* (2013.01)

(58) Field of Classification Search
CPC ..... F04C 2/16–165; F04C 18/16–165; F04C 2240/50–56; F04C 15/0084; F01C 1/16–165
See application file for complete search history.

(56) References Cited

U.S. PATENT DOCUMENTS

| | | | | |
|---|---|---|---|---|
| 2,693,762 | A * | 11/1954 | Sennet | F04C 2/165 418/197 |
| 2,693,763 | A | 11/1954 | Sennet | |
| 9,765,776 | B2 | 9/2017 | Metz | |
| 11,293,433 | B2 | 4/2022 | Deichmann | |
| 11,306,715 | B2 | 4/2022 | Deichmann | |
| 11,339,781 | B2 | 5/2022 | Deichmann | |
| 2011/0014079 | A1 | 1/2011 | Pauwels | |

(Continued)

FOREIGN PATENT DOCUMENTS

| | | | |
|---|---|---|---|
| CH | 469198 | A * | 2/1969 |
| DE | 7802765 | U1 | 10/1979 |
| DE | 3920900 | A1 | 1/1991 |

(Continued)

OTHER PUBLICATIONS

European Patent Office issued a European Search Report dated Feb. 2, 2022 regarding parallel European Patent Application No. 21 189 862.2, 10 Pages.

(Continued)

*Primary Examiner* — Laert Dounis
(74) *Attorney, Agent, or Firm* — Lucas & Mercanti, LLP; Klaus P. Stoffel

(57) ABSTRACT

A screw spindle pump, including a housing and a drive spindle accommodated therein and at least one running spindle which meshes with the latter and which has in each case two terminal end surfaces. A stop surface is provided axially adjacent to at least one end surface of the running spindle, wherein the running spindle is accommodated displaceably with an axial clearance perpendicular to the stop surfaces.

20 Claims, 2 Drawing Sheets

(56) References Cited

U.S. PATENT DOCUMENTS

| | | | | |
|---|---|---|---|---|
| 2011/0268598 | A1* | 11/2011 | Paval | F04C 15/0038 418/83 |
| 2019/0085844 | A1* | 3/2019 | Trossmann | F04C 15/0042 |

FOREIGN PATENT DOCUMENTS

| | | | | |
|---|---|---|---|---|
| DE | 19502173 | A1 | 8/1996 | |
| DE | 102006049663 | A1 * | 5/2008 | F04C 15/0042 |
| DE | 102006049663 | A1 | 5/2008 | |
| DE | 102014102390 | B3 | 3/2015 | |
| DE | 102017210767 | A1 | 12/2018 | |
| DE | 102017210771 | A1 | 12/2018 | |
| EP | 3645890 | A1 | 5/2020 | |
| FR | 2981993 | A1 | 5/2013 | |
| JP | 05001685 | A * | 1/1993 | |
| RU | 2030639 | C1 | 3/1995 | |
| WO | 2019002206 | A1 | 1/2019 | |

OTHER PUBLICATIONS

German Patent and Trademark Office issued Office Action dated Sep. 28, 2021 regarding the parallel German Patent Application No. 102020133555.5, 8 Pages.

Russian Patent Office issued an Office Action dated May 25, 2022 regarding parallel Russian Patent Application No. 2021130863, 8 Pages.

Indian Patent Office issued an Office Action dated Jun. 23, 2022 regarding parallel Indian Patent Application No. 202144045302, 5 Pages.

* cited by examiner

SCREW SPINDLE PUMP HAVING A STOP SURFACE AXIALLY ADJACENT TO AN END SURFACE OF A RUNNING SPINDLE

CROSS-REFERENCE TO RELATED APPLICATIONS

The present application claims priority of DE 10 2020 133 555.5, filed Dec. 15, 2020, the priority of this application is hereby claimed, and this application is incorporated herein by reference.

BACKGROUND OF THE INVENTION

The invention relates to a screw spindle pump, comprising a housing and a drive spindle accommodated therein and at least one running spindle which meshes with the latter and which has in each case two terminal end surfaces.

Screw spindle pumps are used for conveying a very wide variety of substances, primarily fluid media. A screw spindle pump is known to comprise a housing in which the spindle set, comprising a drive spindle, which is led out of the housing and is coupled to a drive motor, possibly with a gear mechanism interposed, and comprising one or more running spindles, the spindle profiles of which mesh with the spindle profile of the drive spindle and which are driven via the drive spindle. The housing in which the spindle set is accommodated may be the pump housing, which also terminates outwardly, or a housing designed as an insert into an outer housing.

Normally, the one running spindle or the multiple running spindles, generally two running spindles arranged in a parallel manner and so as to be offset by 180° next to the drive spindle, is/are hydraulically supported axially, for which purpose there may be provided adjacent to the end surface of the respective running spindle a nozzle orifice via which a fed proportion of the fluid to be conveyed flows against the spindle end surface in order, in this way, to build up an axial support pressure via which the respective running spindle is supported axially. This necessitates a corresponding formation of the housing, in which a corresponding fluid supply has to be provided via suitable channels, as well as the corresponding nozzle orifices, which, for the generation of the corresponding fluid pressure, also have to be designed and configured in a geometrically corresponding manner.

Screw spindle pumps are increasingly being used also in the food sector and the pharmaceutical sector, that is to say that they are used for conveying corresponding fluid foodstuffs or pharmaceutical substances. Working with such substances requires the highest level of hygiene, and for this reason the screw spindle pumps used also have to be cleaned at correspondingly short intervals. Owing to the complex configuration of the screw spindle pump with regard to the fluid guide means for axial support of the running spindles, which comprises corresponding channels, etc., it is necessary for the purpose of cleaning for the screw spindle pump to be removed and dismantled and cleaned, in order to ensure that cleaning is realized in all regions. This is because, owing to the integration of the additional channels, nozzle orifices, etc, there is a considerable volume which does not participate in the actual conveying process, that is to say is effectively present as dead space, but is nevertheless charged with the fluid.

SUMMARY OF THE INVENTION

The invention is therefore based on the problem of specifying an improved screw spindle pump.

To solve said problem, in a screw spindle pump of the type mentioned in the introduction, it is provided according to the invention that a stop surface is provided axially adjacent to at least one end surface of the running spindle, wherein the running spindle is accommodated displaceably with an axial clearance perpendicular to the stop surface.

In the screw spindle pump according to the invention, no hydraulic axial thrust balancing is provided. Rather, the or, if for example two running spindles are provided, each running spindle is axially assigned, at least on one side, in each case one stop surface, wherein the running spindle is accommodated with a small axial clearance to said stop surface. This/these stop surface(s) is/are consequently situated in the actual pump space. During operation, the drive spindle is driven. Owing to the profile engagement or the hydraulic pressure, the one or the two running spindles also rotate with the drive spindle, with the result that fluid conveyance through the pump space occurs. The drive spindle itself is largely hydraulically balanced, that is to say that no or a negligible axial force acts on the drive spindle as a result of operation. This is achieved in that the pressed, that is to say pressurized, surface of a sealing element sealing off the drive spindle with respect to the housing and the pressed profile surface of the drive spindle profile are substantially equal in size. Since both surfaces are pressed axially in different directions, an equilibrium of forces is thus established, which results in the drive spindle being hydraulically balanced. During operation, the running spindles undergo only a small axial offset, resulting from the pump pressure, in the direction of the or one of the stop surfaces. If the pump is not reversible, the stop surface is provided on the suction side or at the suction-side end of the running spindle since, during operation, the running spindle is displaced slightly toward the suction side. If the pump is reversible, then two stop surfaces are provided for each running spindle, in order in this way for a stop surface to be provided on both sides according to conveying direction and thus movement direction of the running spindle. If the drive spindle pump is reversible with respect to the conveying direction, then this offset is thus realized either with respect to one stop surface or with respect to the other stop surface according to working direction. The offset is possible owing to the small axial clearance, wherein it is possible to configure the axial clearance with respect to the resulting maximum offset. The respective end surface of the running spindle can, during operation, run against the respective axial stop disk, where it is ideally mounted via a thin hydraulic lubricating film or, if it runs against the stop surface, there is only negligible friction. This means that, despite run-up against the stop surface, firstly corresponding mounting and lubrication via the fluid to be conveyed occurs, because, as described, the stop surface is in the pump space, and secondly no wear has to be dealt with.

The screw spindle pump according to the invention therefore not only makes possible corresponding axial support of the running spindles, but also makes no provision at all for specific measures for this purpose other than the integration of two stop disks. The single volume through which the fluid to be conveyed flows is the pump space, which is effectively optimized in terms of dead space. This in turn results in the screw spindle pump according to the invention not having to be dismantled in the case of cleaning, since the cleaning process can be realized in the installed state because the cleaning fluid can correspondingly flush the pump space without any problems. This means that so-called "cleaning in place" (CIP) is possible with the screw spindle pump according to the invention.

As already described, in the case of a non-reversible pump, only the suction-side end surface of the running spindle or of each running spindle can be assigned a stop surface. In the case of a non-reversible pump, a stop surface may be provided axially adjacent to both end surfaces of the running spindle, wherein the running spindle is then accommodated with an axial clearance between both stop surfaces.

As described, the spindle set is hydraulically synchronized, that is to say it is set automatically during operation. In particular, there is no or only a negligible mechanical transmission of force between the drive spindle and the running spindles, resulting in a minimum axial offset of the running spindles during operation. The axial clearance between the running spindle and the axial stop surfaces can therefore also be configured to be correspondingly small, according of course to the given structural size of the screw spindle pump. The axial clearance is preferably between 0.3 mm, for screw spindle pumps of small structural size, and 5.0 mm, for screw spindle pumps of very large structural size, the clearance preferably lying in the range 1.0-3.0 mm. The clearance is configured in consideration of the given axial offset of the running spindles, wherein the stated values in each case concern the total clearance that the respective running spindle has between both stop disks.

Various possibilities are provided with regard to the realization of the stop surfaces. In this respect, the or each stop surface may be formed by means of a coating on the housing. Here, therefore, one or more corresponding housing shoulders are provided on the housing side, said housing shoulders forming the basis for the stop surface, which is realized by means of a coating of the housing shoulder. Alternatively, the or each stop surface may also is realized by means of a stop disk. Here, therefore, for realizing the stop surface, a specific stop disk is inserted into the housing at a corresponding position. The clearance can be set very exactly via the thickness of the stop disk.

Preferably, extremely low-wear surfaces are provided as stop surfaces, that is to say that a correspondingly low-wear material is used. Coatings or stop disks composed of a ceramic or carbide material or of a ceramic or carbide material-containing composite material are suitable for this purpose. This means that use is basically made of a technical ceramic which may possibly be reinforced with glass or carbon fibers. Use is expediently made of a ceramic material or a technical ceramic which is silicon-based, wherein in particular SiC or $Si_3N_4$ is suitable for this purpose, or WC, which material, as described, may also be fiber-reinforced according to requirement. The use of $Cr_2O_3$ is also conceivable. Alternatively, a hard metal may also be used for forming the coating, and also the stop disk(s) may be composed of hard metal or may have hardened surfaces. The hardness should be at least 1000 HV. The stop surfaces or the coatings or axial disks therefore do not have a tendency to wear, similar to the running spindles, which are manufactured from steel and preferably kolsterized or cold-nitrided and, as described, are ideally mounted slidingly via the hydrostatic lubricating film on the stop surfaces or coatings or stop disks.

The or each running spindle is accommodated in a corresponding running spindle bore which overlaps a drive spindle bore accommodating the drive spindle, wherein the one or the two running spindle bores is/are delimited axially via one or two axial housing shoulders, on which housing shoulder(s) the respective stop surface is formed or the respective stop disk is supported. Accordingly, provision is made in the housing of one or more defined shoulders, which serve either as carriers for the coating(s) or as axial support points for the stop disks. Thus, either the coating is applied directly to such a housing shoulder, or a stop disk bears against such a housing shoulder. Here, the axial spacing of two housing shoulders can be defined and set very exactly, such that defined geometrical relationships are set and also, in the case of separate stop disks being used, the axial clearance of the respective running spindle can, through selection of the corresponding stop disk thicknesses, be set in a correspondingly exact manner.

As described, the drive spindle is preferably hydraulically balanced such that no appreciable axial force pushing the drive spindle in one direction acts on the drive spindle, which would then in turn lead to a displacement of the running spindles. The running spindles, which are mounted effectively in an axially overhung manner, are slightly moved axially, with utilization of the axial clearance, solely by way of the pressure building up in the pump housing, where the profile engagement allows this. The drive spindle and the running spindles are accommodated here in a pump space, which, via a sealing element, preferably an individual sealing element, which seals off between the drive spindle and the housing, is sealed off with respect to a drive side of the drive spindle. This means that the pump space is sealed off with respect to one side via just one sealing element. Then, according to the invention, said sealing element is selected or configured in such a way in relation to the dimension and geometry of the drive spindle that the axially pressed surface of the sealing element corresponds substantially to the axially pressed surface of the drive spindle or of the drive spindle profile. In this way, the axial hydraulic balancing is realized, said axial hydraulic balancing having proven to be particularly advantageous with regard to hydraulic synchronization of the spindle set and the minimization of the resulting axial running-spindle offset during operation. The pressed surface of the annular sealing element, through which the drive spindle passes, corresponds ultimately to its axial annular surface facing the pump space. The pressed surface of the drive spindle, as seen in the spindle longitudinal direction, is made up, as known, of multiple, partly also sickle-shaped surface portions of the spindle profile, which projects radially from the spindle core, as a result of the engagement of the spindle profile into the two spindle profiles of the running spindles. The difference between the two pressed surface areas should be at most 10%, preferably only at most 5%, and ideally of course should be zero, so that, if at all, only a very small resultant axial force occurs, which brings about neither an axial offset of the drive spindle nor any appreciable loading of the spindle bearing arrangement.

The sealing element itself is preferably a mechanical seal, which is preferably arranged on the drive spindle and seals off with respect to a corresponding sealing portion or sealing seat on the housing.

Expediently, the drive spindle itself is rotatably mounted radially in the housing only on one side outside a pump space, which pump space has the working spindle and running spindles and out of which the drive spindle is led with a portion. For this purpose, use is expediently made of a radial bearing, wherein preferably only a single radial bearing is used. This may be a single- or multiple-row bearing in the form of a ball bearing, or of a roller- or barrel-type bearing, etc., that is to say a rolling bearing. Owing to the hydraulic balancing of the drive spindle that is provided on one side and the arrangement of two running spindles arranged offset by 180° next to the drive spindle, it is possible for just a simple radial bearing to be used, since this is almost free of load during operation owing to the corresponding balance of forces.

One expedient refinement of the invention provides that at least the or each running spindle bore is lined with a slide lining, wherein the running spindles are arranged with a radial clearance with respect to the slide lining. The lining of the running spindle bores with the slide lining also serves for the reduction of any dead space. This is because, during normal operation, no radial movements of the running spindles occur, but rather there is likewise formed, between the spindle lateral surface and the running spindle bores or the slide lining, a thin hydraulic lubricating film, which mounts the running spindle. In turn, this then makes it possible for the radial running spindle clearance, via the slide lining, to be correspondingly minimized and also, in this way, for the dead space to be correspondingly reduced.

As such a slide lining, use is expediently made of a plastic lining composed in particular of a hydrogenated acrylonitrile butadiene rubber (HNBR), chlorotrifluoroethylene, an ethylene propylene diene (monomer) rubber (EPDM), polytetrafluoroethylene (PTFE), a perfluoroalkoxy polymer, a fluorinated rubber (FKM) or a perfluorinated rubber (FFKM). However, this list is not exhaustive, but rather it is possible for use to also be made of other suitable plastic materials, as long as they are suitable for the use with regard to the medium to be conveyed.

The thickness of the slide lining is preferably set such that the radial clearance is between 0.01 and 1.00 mm, in particular between 0.05 and 0.5 mm. This means that, here, there is an extremely small radial clearance, resulting simply from the fact that no appreciable radial movement occurs during operation.

Beside the dead space-optimized configuration of the screw spindle pump, the configuration of the screw spindle pump furthermore has, with regard to the minimization of the axial clearance and also of the radial clearance, the advantage that the efficiency of the screw spindle pump can be increased significantly, up to several 10%, in comparison with hitherto conventional screw spindle pumps. This is because, owing to the minimum clearances, a constant volume flow is established over a wide pressure range, with backflow of the medium to be delivered scarcely occurring since the existing gaps are minimal. This means that a significantly more efficient conveyance operation can be realized, which is associated with a configuration of the screw spindle pump that is extremely advantageous in terms of hygiene.

As described, the screw spindle pump serves in particular for conveying critical substances, for the processing of which the highest level of cleanliness is required. Accordingly, the screw spindle pump according to the invention is used for conveying viscous or pasty foodstuffs, or pharmaceutical, cosmetic or chemical media. Viscous or pasty foodstuffs may be for example dairy products such as cream cheese, cream, quark, butter or yogurt. Also conceivable is the conveyance of significantly more viscous or pasty foodstuffs, such as ketchup, mayonnaise, mustard and the like, horseradish, processed cheese, vegetable oils, liquid egg, dough or fruit purée, and also of gelatin, syrup, nut or nougat creams, chocolate, honey, marzipan or other fats or oils. As media that can be conveyed in the pharmaceutical and cosmetic sectors, mention is made for example of liquid soaps, creams or lotions or the like. In the chemical industry, mention is made by way of example of liquid laundry detergent, dishwashing detergent, or cleaning agent, and also of lacquers or the like. Here, too, the list is of course not exhaustive, but shows that the viscosity of the conveyable materials extends over an extremely broad range. The viscosity of the conveyable substances for the conveyance of which the screw spindle pump according to the invention can be used lies in the range 0.5-1 million $kg \cdot m^{-1} \cdot s^{-1}$.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
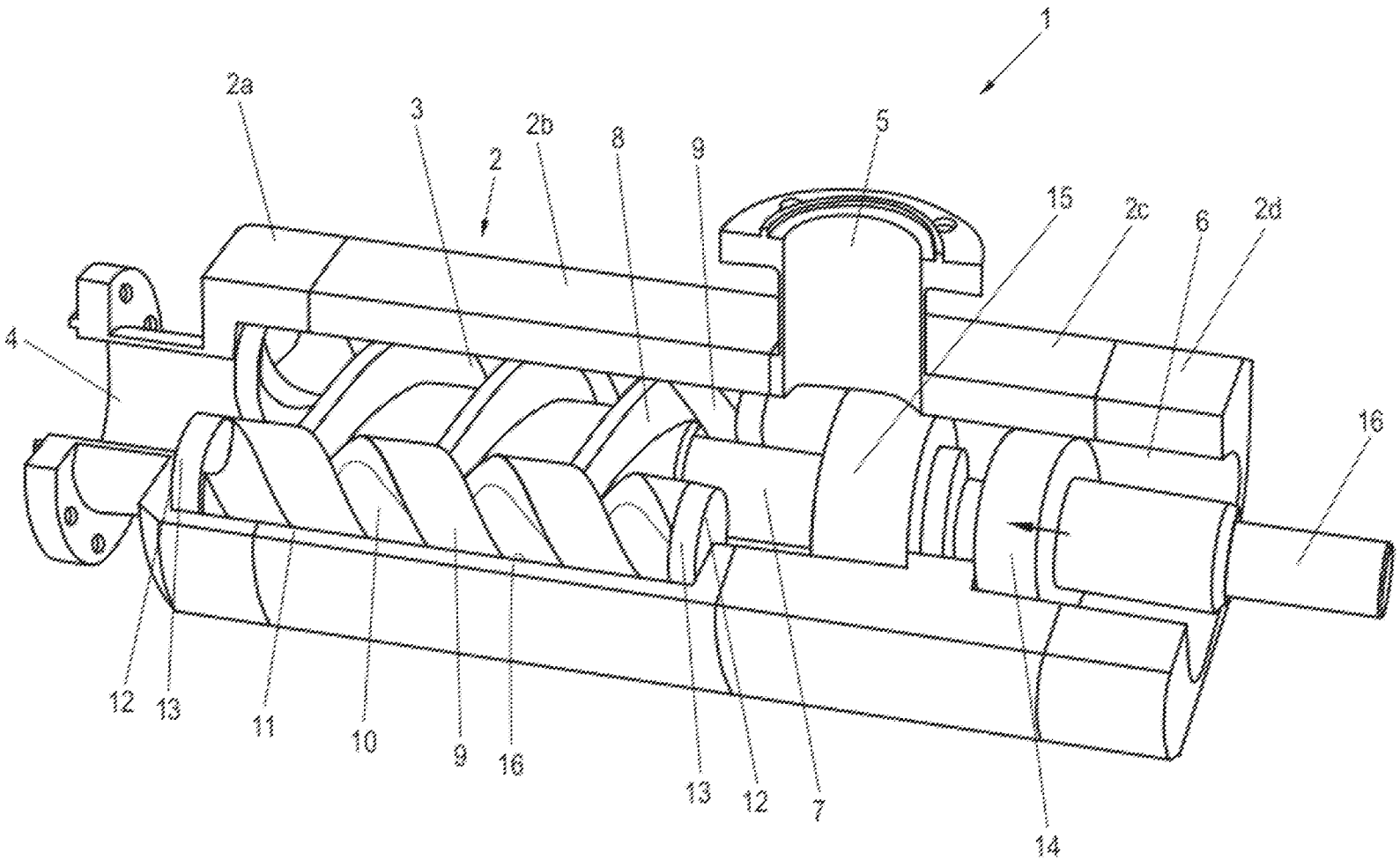
FIG. 1 shows, in a quarter section, a basic illustration of a screw spindle pump according to the invention of a first embodiment.

FIG. 1 shows, in a partial section, a screw spindle pump 1 according to the invention comprising a housing 2, which here, by way of example, consists of four housing parts 2*a*, 2*b*, 2*c* and 2*d*. The housing is therefore of modular construction. A pump space 3 with an axial access 4 and with a radial access 5 is formed in the housing interior. The conveying direction of the screw spindle pump 1 is reversible, that is to say, according to conveying direction, the access 4 can be the suction connector and the access 5 can be the pressure connector, or vice versa. Even though a radial access 5 and an axial access 4 are shown here, the access configuration may also be different, for example with two radial accesses, which may also be offset about the housing longitudinal axis.

Beside the pressure space 3, the housing 2 also has a bearing space 6, in which, as will be described below, the mounting of a drive spindle is realized.

The screw spindle pump 1 furthermore comprises a spindle set, comprising a centrally arranged drive spindle 7 with a drive spindle profile 8 and two running spindles 9, arranged laterally adjacently and so as to be offset from one another by 180°, with respective running spindle profiles 10, wherein the drive spindle profile 8 meshes with the running spindle profiles 10. The example shows two running spindles 9, it being alternatively also possible for only one running spindle 9 or for three running spindles 9 to be provided.

The drive spindle 7 or the drive spindle profile 8 is accommodated in a corresponding drive spindle bore (not shown in more detail here) in the housing 2 or in the housing part 2*b*, while the two running spindles 9 are accommodated in corresponding running spindle bores 11 in the housing 2 or in the housing part 2*b*. The two running spindle bores 11 overlap the drive spindle bore 9 in a known manner, wherein the bores form a substantial part of the pump space 3.

In the region of the two running spindle bores 11, the two housing parts 2*a* and 2*c* have corresponding housing shoulders 12, which serve as support surfaces for in each case one stop disk 13, which stop disks are axially spaced apart from one another and accommodate between them in each case one running spindle 9. Each stop disk 13 forms a stop surface for the end surface of the axially adjacent running spindle 9 or has such a stop surface. They are planar on both sides, thus bearing in a planar manner against the corresponding housing shoulders 12 as well as being surface-parallel to the corresponding planar end surfaces of the running spindles 9. Each running spindle 9 is accommodated between the two stop disks 13 with a small axial clearance, between 0.3 and 5.0 mm, in particular between 1.0 and 3.0 mm, according to the structural size of the screw spindle pump, and can thus be slightly displaced axially. The maximum axial clearance is set via the thickness of the stop disks 13 used, so that it can be minimized and the dead space there can be minimized.

The stop disks 13 are for example disks composed of a ceramic material or composed of a ceramic material-containing composite material, preferably composed of a technical ceramic. Preferably, use is made of a silicon-based material, in particular SiC or $Si_3N_4$. Alternatively, each stop disk 13 may also be composed of a carbide material, for example WC. The use of stop disks 13 composed of hard metal is also conceivable. Extremely low-wear stop disks 13 are thus involved, wherein the respective running spindle 9, which is manufactured from a corresponding, for example kolsterized or cold-nitrided high-grade steel, is correspondingly wear-resistant too. Both the spindles and the housing are manufactured from a stainless high-grade steel, which is suitable in particular for use in the food industry, the medical industry, the pharmaceutical industry and the chemical industry.

The drive spindle 7 is, as the partially sectional figure shows, guided out of the pump space 3 into the bearing space 6, where it is mounted via a radial bearing 14, a rolling bearing preferably in the form of a single- or multiple-row ball bearing or of a roller- or barrel-type bearing, in the housing 2. In this way, the rotational mounting of the drive spindle 7 is thus realized in a single bearing plane. A single such bearing plane is sufficient since, as will be discussed below, the drive spindle 7 is hydraulically balanced axially, the drive spindle 7 being acted on during pump operation as a consequence therefore by no or only a negligible axial force, and also however by no or only a negligible radial force as a result of the symmetrical arrangement of the two running spindles 7 on both sides, which for their part are hydraulically supported or mounted via a lubricating film, specifically both axially and radially, which will be discussed below.

Furthermore, provision is made of a single sealing element 15, this preferably being a radial mechanical seal which is arranged on the drive spindle 7 and seals off with respect to a corresponding sealing seat in the housing 2. Via this one spindle seal or sealing plane, the entire pump room 3 is sealed off with respect to this side, that is to say with respect to the drive side. This means that the fluid or medium can flow only from the access 4 to the access 5, or vice versa, there being excluded a passage toward the bearing side or drive side (the actual pump drive being connected to the corresponding end-side running-spindle connecting piece 16).

As described, the drive spindle 7 is hydraulically balanced axially, so that no or only a completely negligible axial force acts on the drive spindle 7. This is achieved in that, with respect to the drive spindle profile 8, the sealing element 15 is designed in a corresponding manner. The design is such that that surface of the sealing element 15 which is subjected to pressure by the medium, that is to say effectively the surface facing in the direction of the pump space 3, is substantially equal in size to the axially pressed surface of the working spindle profile 8. The axially pressed surface of the working spindle profile 8, as seen in the spindle longitudinal direction, is made up, in a known manner resulting from the meshing engagement of the working spindle profile 8 into the running spindle profiles 10, of multiple, partly sickle-shaped surface portions of the working spindle profile 7, which surface portions combine additively to form a total surface. Said total surface is then almost or, ideally, completely equal in size to that annular surface of the sealing element 15 which faces toward the pump space and is pressed axially. Any difference in surface area should be at most 10%, preferably at most 5%. The pressures acting on the respective surfaces are each directed oppositely with respect to one another, and so, since both surfaces are subjected to the same pressure, an ideally complete pressure balance is the result and accordingly the drive spindle 7 is effectively free of pressure or hydraulically balanced, so that, ideally, no or only a negligible axial force acts thereon.

As a result, it is however consequently also the case that there is no mechanical transmission of force to the two running spindles from the drive spindle 7, since this is positionally fixed axially during operation. Only a working pressure-induced, small axial displacement of the running spindles 9 occurs, which leads to a small axial movement of the running spindles 9 in the running spindle bores 11 and to the corresponding end surface of the respective running spindle 9 running up against the respective stop disk 13. The two surfaces running against one another are preferably slidingly mounted hydrostatically via a thin lubricating film of the medium to be conveyed, so that, in this region, no wear occurs.

For further minimization of the dead space and for improvement of the efficiency, resulting from a minimization of the medium backflow via existing gaps, the respective running spindle bore 11 is furthermore provided with a slide lining 16, this preferably being a slide lining 16 composed of a plastic such as HNBR, EPDM, PTFE, CTFE, PFA, FKM or FFKM. The thickness of the slide lining 16 is selected in such a way that only a minimal radial clearance between the respective running spindle 9, that is to say the outer lateral surface thereof, and the slide lining 16 is obtained, wherein said radial clearance should lie between 0.01 and 1.0 mm, in particular between 0.05 and 0.5 mm. This means that, here too, there is only a minimum clearance, thus allowing minimization of any backflow, which is associated with an improvement of the efficiency. Here, too, there is effectively established a corresponding medium lubricating film, via which the running spindles 9 are effectively mounted slidingly with respect to the slide lining 16, with the result that, here too, no abrasion occurs.

During operation, the drive spindle 7 is driven via the drive in a known manner, said drive spindle rotating. Via the profile engagement, there necessarily occurs rotation also of the running spindles 9 and the corresponding conveyance of the medium from the access 4 to the access 5, or vice versa, that is to say from the suction connector to the pressure connector, according to the direction of rotation of the drive spindle 7. During the run-up, the two running spindles 9 are, as described, axially displaced minimally by way of the build-up of the working pressure and resulting from the minimum axial clearance within the profile engagement, and in each case run against one of the stop disks 13, where they are preferably mounted slidingly via the formed lubricating film from the medium to be conveyed. Owing to the minimum gaps, an extremely small backflow occurs, which leads to an improvement of the efficiency.

Figure 2:
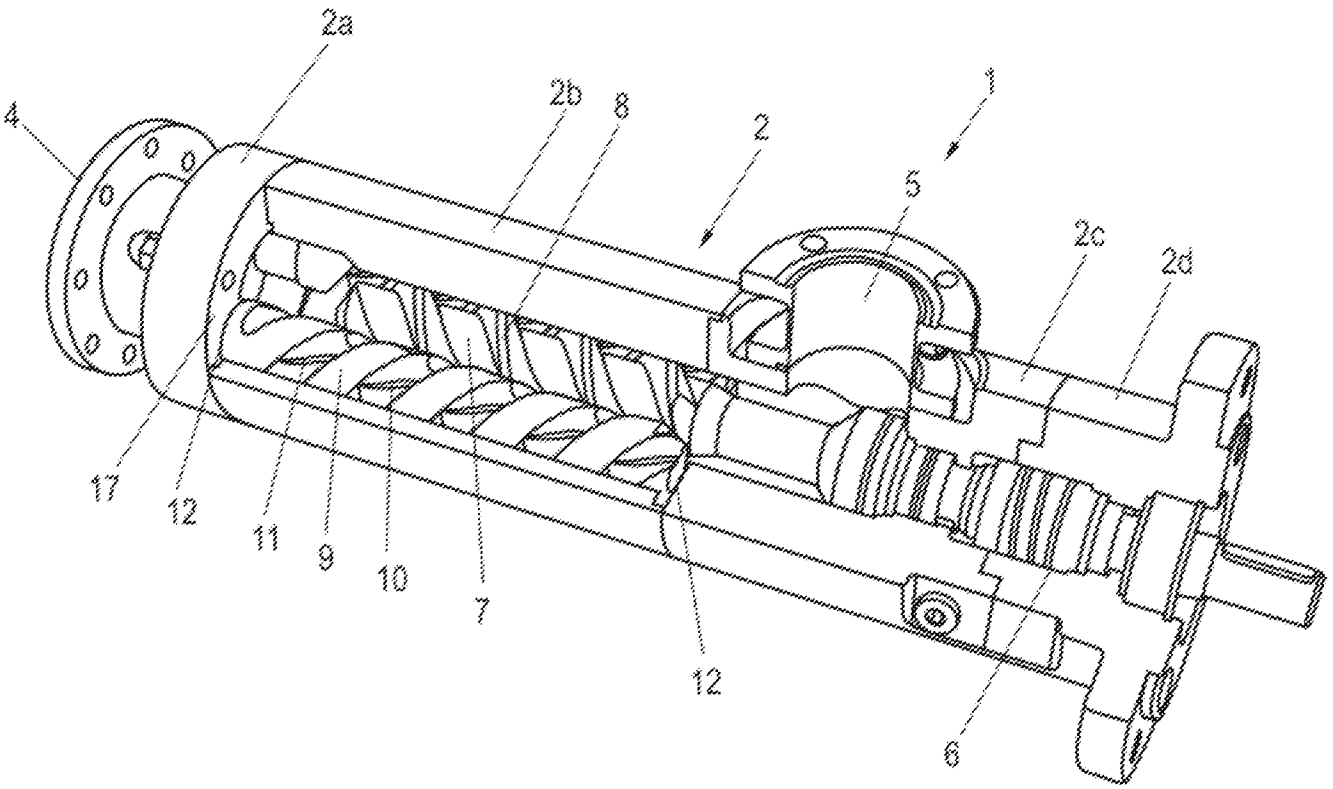
FIG. 2 shows, in a quarter section, a basic illustration of a screw spindle pump according to the invention of a second embodiment.

The exemplary embodiment of the screw spindle pump 1 as per FIG. 2 corresponds to that from FIG. 1 in terms of basic construction. Here, too, there is provided a modular housing 2 comprising by way of example three housing parts 2*a*, 2*b*, 2*c* and 2*d*. A pump space 3 with an axial access 4 and with a radial access 5 is formed in the housing interior. Here, too, the conveying direction of the screw spindle pump 1 is reversible. Beside the pressure space 3, the housing 2 also has a bearing space 6, in which, as will be described below, the mounting of a drive spindle is realized.

Here, too, the screw spindle pump 1 comprises a spindle set, having a central drive spindle 7 with a drive spindle profile 8 and two laterally adjacent running spindles 9, arranged so as to be offset from one another by 180°, with respective running spindle profiles 10, wherein the drive spindle profile 8 meshes with the running spindle profiles 10. The example shows two running spindles 9, it being alternatively also possible for only one running spindle 9 or for three running spindles 9 to be provided.

The drive spindle 7 is accommodated in a corresponding drive spindle bore in the housing 2, while the two running spindles 9 are accommodated in corresponding running spindle bores 11 in the housing 2. The two running spindle bores 11 overlap the drive spindle bore 9 in a known manner, wherein the bores again form a substantial part of the pump space 3.

In the region of the two running spindle bores 11, the two housing parts 2*a* and 2*c* have corresponding housing shoulders 12. The housing shoulders 12 are axially spaced apart from one another are. In each case one running spindle 9 is accommodated between them. Each housing shoulder 12 is provided with a coating 17 which forms a stop surface for the end surface of the axially adjacent running spindle 9. The coating 17 is composed for example of $Si_3N_4$, SiC, WC or $Cr_2O_3$ and is applied directly to the respective housing shoulder 12. The end surfaces of the running spindles 9 are planar, thus bearing in a planar manner with respect to or against the corresponding coatings 17 of the housing shoulders 12. Each running spindle 9 is accommodated between the two housing shoulders 12 or the low-wear coatings 17 with a small axial clearance, between 0.3 and 5.0 mm, in particular between 1.0 and 3.0 mm, according to the structural size of the screw spindle pump, and can thus be slightly displaced axially. Here, too, the running spindles 9, during operation, run against the stop surfaces, or coatings 17, and ideally are supported or slidingly mounted there via a hydraulic lubricating film. The coatings at any rate exhibit, like the running spindles themselves, extremely low wear, and so permanent operation is ensured.

Thus, here, the stop surfaces are realized directly on the housing itself by means of the coatings 17. The arrangement of the separate stop disks, as in the exemplary embodiment according to FIG. 1, is not necessary here. The same advantages as those described for the exemplary embodiment according to FIG. 1 are still achieved.

Otherwise, the construction of the screw spindle pump 1 shown in FIG. 2 corresponds to the example from FIG. 1, that is to say that, here too, a radial bearing 15 for mounting the drive spindle 7 is provided and at least the running spindle bores 11 are also lined with a slide lining 16. Reference is therefore made to the statements with regard to the pump from FIG. 1, these applying equally to the pump according to FIG. 2.

For the case in which the screw spindle pump 1 is not reversible, only one stop disk 13, or coating 17, forming the stop surface is provided for each running spindle bore 11, specifically at the suction-side end of the respective running spindle bore, because the running spindle 9 moves by a minimal amount toward the suction side during operation.

It can be seen that the screw spindle pump according to the invention has a simple design, since it manages without a device for hydraulic thrust balancing of the running spindles 7, said device being disadvantageous in the case of conveyance of foodstuffs or other hygienically sensitive media. It is rather the case that the configuration of the screw spindle pump allows it to be able to be cleaned in the assembled state, since, apart from the pump space, there are no other volumes in which the medium to be conveyed can be contained. This makes possible simple flushing of the screw spindle pump in the installed state, that is to say "cleaning in place". The integration of the stop disks 13 allows the permissible axial clearance of the running spindles 9 to be minimized, wherein, as stated, direct disk run-up is realized, so that there is no disadvantageous dead space in this pump space region.

Through the use of three spindles, specifically the drive spindle 7 and the two running spindles 9, a relatively pressure-stiff conveyance characteristic curve is made possible since the screw spindle pump 1 has a very dense profile. This allows applications with greater dosing accuracy. The dense profile also results in better suction behavior, resulting in an improvement of the efficiency. Furthermore, the screw spindle pump 1 or the spindle set is also hydraulically synchronized, that is to say is set automatically during operation, with there being no mechanical transmission of force between the drive spindle 7 and the running spindles 9.

While specific embodiments of the invention have been shown and described in detail to illustrate the inventive principles, it will be understood that the invention may be embodied otherwise without departing from such principles.

We claim:

1. A screw spindle pump, comprising; at least one running spindle not having a hydraulic axially just balancing; a housing and a drive spindle accommodated therein and the at least one running spindle which meshes with the latter and which has in each case two terminal end surfaces, wherein the drive spindle is hydraulically balanced so that during a pumping operation no or only a negligible axial force acts on the drive spindle, wherein a stop surface is provided axially adjacent to at least one end surface of the terminal end surfaces of the at least one running spindle, wherein the at least one running spindle is accommodated displaceably with an axial clearance perpendicular to the stop surface and is movable against the stop surface.

2. The screw spindle pump according to claim 1, wherein a stop surface is provided axially adjacent to both end surfaces of the at least one running spindle, wherein the at least one running spindle is accommodated with an axial clearance between both stop surfaces.

3. The screw spindle pump according to claim 1, wherein the axial clearance is between 0.3 and 5.0 mm.

4. The screw spindle pump according to claim 1, wherein the stop surface is formed by a coating on the housing, or wherein the stop surface is realized by a stop disk.

5. The screw spindle pump according to claim 4, wherein the coating or the stop disk consists of a ceramic or carbide material or of a hard metal or of a ceramic or carbide material-containing composite material.

6. The screw spindle pump according to claim 4, wherein the coating or the stop disk is composed of a silicon-based material of WC or of $Cr_2O_3$.

7. The screw spindle pump according to claim 4, wherein the at least one running spindle is accommodated in a running spindle bore which overlaps a drive spindle bore accommodating the drive spindle, wherein the running spindle bores are delimited axially via one or two axial housing shoulders, on which housing shoulder(s) the stop surface is formed or the stop disk is supported.

8. The screw spindle pump according to claim 1, wherein the drive spindle and the at least one running spindle are accommodated in a pump space, which, via a sealing element which seals off between the drive spindle and the housing, is sealed off with respect to a drive side of the drive spindle.

9. The screw spindle pump according to claim 8, wherein an axially pressed surface of the sealing element corresponds substantially to an axially pressed surface of the drive spindle.

10. The screw spindle pump according to claim 8, wherein the sealing element is a mechanical seal.

11. The screw spindle pump according to claim 8, wherein the sealing element is arranged on the drive spindle and seals off with respect to a sealing portion on the housing.

12. The screw spindle pump according to claim 1, wherein the drive spindle is rotatably mounted in the housing only on one side at a portion that extends outside a pump space, which pump space has the drive spindle and the at least one running spindle.

13. The screw spindle pump according to claim 12, wherein the rotatable mounting is realized via a radial bearing.

14. The screw spindle pump according to claim 1, wherein at least one running spindle bore is lined with a slide lining, wherein the at least one running spindle is arranged with a radial clearance with respect to the slide lining.

15. The screw spindle pump according to claim 14, wherein, the slide lining consists of a hydrogenated acrylonitrile butadiene rubber, chlorotrifluoroethylene, an ethylene propylene diene (monomer) rubber, polytetrafluoroethylene, a perfluoroalkoxy polymer, a fluorinated rubber or a perfluorinated rubber.

16. The screw spindle pump according to claim 14, wherein the radial clearance is between 0.01 and 1.0 mm.

17. A method for conveying viscous or pasty foodstuffs, or pharmaceutical, cosmetic or chemical media comprising utilizing the screw spindle pump according to claim 1.

18. The screw spindle pump according to claim 3, wherein the axial clearance is between 1.0 and 3.0 mm.

19. The screw spindle pump according to claim 6, wherein wherein the coating or the stop disk is composed of SiC or $Si_3N_4$.

20. The screw spindle pump according to claim 16, wherein the radial clearance is between 0.05 and 0.5 mm.

* * * * *